US006118645A

United States Patent [19]

Partridge

[11] Patent Number: 6,118,645

[45] Date of Patent: Sep. 12, 2000

[54] SELF-BALANCING BIPOLAR AIR IONIZER

[75] Inventor: Leslie W. Partridge, Emeryville, Calif.

[73] Assignee: Ion Systems, Inc., Berkeley, Calif.

[21] Appl. No.: 08/418,267

[22] Filed: Apr. 6, 1995

Related U.S. Application Data

[63] Continuation of application No. 08/222,189, Mar. 31, 1994, abandoned, which is a continuation of application No. 07/931,108, Aug. 17, 1992, abandoned, which is a continuation of application No. 07/728,565, Jul. 11, 1991, abandoned, which is a continuation of application No. 07/567,595, Aug. 15, 1990, Pat. No. 5,055,963.

[51] Int. Cl.[7] ..... H01T 23/00

[52] U.S. Cl. ..... 361/231; 361/235; 55/385.2; 250/423 R

[58] Field of Search ..... 55/2, 101, 131, 55/464, 385.2; 361/213, 215, 220, 227, 231, 232, 235, 752; 250/324–326, 423 R

[56] References Cited

U.S. PATENT DOCUMENTS

| | | | |
|---|---|---|---|
| 2,589,613 | 3/1952 | Hicks | 361/231 |
| 2,847,324 | 8/1958 | Ogint | 361/215 |
| 3,263,127 | 7/1966 | Point et al. | 361/227 |
| 3,403,252 | 9/1968 | Nagy | 361/231 |
| 3,504,227 | 3/1970 | Wooton et al. | 361/231 |
| 3,582,711 | 6/1971 | Jahnke | 361/231 |
| 3,624,448 | 11/1971 | Saurenman | 361/231 |
| 3,654,534 | 4/1972 | Fischer | 361/231 |
| 3,711,743 | 1/1973 | Bolasny | 361/231 |
| 3,853,512 | 12/1974 | Hayashi | 361/231 |
| 3,873,835 | 3/1975 | Ignatjev | 361/231 |
| 4,092,543 | 5/1978 | Levy | 250/423 R |
| 4,156,267 | 5/1979 | Spaulding et al. | 361/230 |
| 4,188,530 | 2/1980 | Miller | 250/324 |
| 4,253,852 | 3/1981 | Adams | 361/230 |
| 4,258,408 | 3/1981 | Cantelli | 361/213 |
| 4,317,661 | 3/1982 | Sasaoka et al. | 361/231 |
| 4,319,302 | 3/1982 | Moulden | 361/231 |
| 4,333,123 | 6/1982 | Moulden | 361/231 |
| 4,366,525 | 12/1982 | Baumgartner | 361/231 |
| 4,473,382 | 9/1984 | Cheslock | 55/484 |
| 4,496,375 | 1/1985 | Le Vantine | 55/385.3 |
| 4,542,434 | 9/1985 | Gehlke et al. | 361/231 |
| 4,596,585 | 6/1986 | Moeller et al. | 55/385.2 |
| 4,689,715 | 8/1987 | Halleck | 361/213 |
| 4,729,057 | 3/1988 | Halleck | 361/213 |
| 4,740,862 | 4/1988 | Halleck | 361/231 |
| 4,757,422 | 7/1988 | Bossard et al. | 361/231 |
| 4,768,126 | 8/1988 | Le Vantine | 361/213 |
| 4,829,398 | 5/1989 | Wilson | 361/231 |
| 4,864,459 | 9/1989 | Larigaldie et al. | 361/216 |
| 4,901,194 | 2/1990 | Steinman et al. | 361/213 |
| 4,951,172 | 8/1990 | Steinman et al. | 361/213 |
| 4,980,796 | 12/1990 | Huggins | 361/231 |
| 5,010,777 | 4/1991 | Yehl et al. | 361/231 |
| 5,017,876 | 5/1991 | Wright et al. | 96/22 |

FOREIGN PATENT DOCUMENTS

| | | |
|---|---|---|
| 1 140 629 | 2/1983 | Canada . |
| 2234228 | 3/1973 | Germany . |

OTHER PUBLICATIONS

3M Electrical Specialties Division "Unique Ionized Air Blower Intrinsically Generates Ion–Balanced Air", 1991.

*Primary Examiner*—Leo P. Picard
*Assistant Examiner*—John B. Vigushin
*Attorney, Agent, or Firm*—Fenwick & West LLP

[57] ABSTRACT

An air ionizing apparatus that produces both positive and negative ions has a housing with air inlet and outlet passages, a plurality of spaced apart air ionizing electrodes and a high voltage supply which applies positive and negative voltages to separate electrodes. A fan creates an airflow that carries the ions out of the housing, the fan preferably being between the electrodes and the outlet passages to promote intermixing of positive and negative ions.

3 Claims, 3 Drawing Sheets

SELF-BALANCING BIPOLAR AIR IONIZER

This is a continuation of application Ser. No. 08/222,189 filed on Mar. 31, 1994, now abandoned, which is a continuation of application Ser. No. 07/931,108 filed on Aug. 17, 1992, now abandoned, which is a continuation of Ser. No. 07/728,565 filed on Jul. 11, 1991, now abandoned, which is a continuation of Ser. No. 07/567,595 filed on Aug. 15, 1990, now issued as U.S. Pat. No. 5,055,963.

TECHNICAL FIELD

This invention relates to apparatus for increasing the ion content of air and more particularly to air ionizers which produce both positive and negative ions.

BACKGROUND OF THE INVENTION

Increasing the ion content of the air within a room can be desirable for a variety of reasons. For example, a high negative ion content freshens the air and has beneficial physiological effects on persons who breathe the air. Air ions of either polarity act to remove dust, pollens, smoke and the like by imparting an electrical charge to such particulates. The charged particles are electrostatically attracted to walls or other nearby surfaces and tend to cling to such surfaces.

Some usages of air ionizers require production of both positive and negative ions. Most notably it has been found that a high concentration of both types of ion acts to suppress accumulations of static electricity on objects in a room. Static electrical charges attract air ions of the opposite polarity and the attracted ions then neutralize the static charges. This can be of particular value in certain industrial operations such as in the clean rooms where microchips or other miniaturized electronic components are manufactured. Accumulations of static charge attract contaminants to such products and may also directly damage a microchip or the like.

An advantageous type of ionizing device has sharply pointed electrodes to which high voltages of the order of several thousand volts are applied and which are exposed to the ambient air. Positive and negative high voltages are applied to separate electrodes or are alternately applied to the same electrode. The resulting intense electrical field near the pointed end of the electrode converts the nearby molecules of the constituent gases of air into positive and negative ions. Ions with a polarity opposite to that of the high voltage are attracted to the electrode and neutralized. Ions of the same polarity as the high voltage are repelled by the electrode and by each other and disperse outward into the surrounding air. Dispersal of the ions is usually accelerated by directing an airflow through the electrode region and out into the room.

The positive and negative ions in the air flow should be thoroughly intermixed if the apparatus is to suppress static charges on objects rather than creating such charges. This condition is not met immediately since the ions of different polarity are produced at separated electrodes or at different time periods at the same electrode. Such intermixing does occur gradually as the airflow progresses away from the ionizing apparatus but it has heretofore been necessary to keep the ionizer a sizable distance away from objects that are to be protected to avoid subjecting the objects to incompletely mixed concentrations of ions of one polarity. It would be more convenient in many instances if the ionizer could be closer to the objects on which static charge is to be suppressed.

The present invention is directed to overcoming one or more of the problems discussed above.

SUMMARY OF THE INVENTION

In one aspect of the invention, a bipolar air ionizing apparatus includes a housing having an interior chamber, at least one air inlet passage and at least one air outlet passage. At least a pair of spaced apart electrodes are disposed in the housing and are exposed to ambient air. The apparatus further includes high voltage supply means for applying high voltages to the electrodes including both positive and negative voltages in order to produce both positive and negative ions in the ambient air. A fan draws air into the housing through the inlet passage and directs air out of the housing through the outlet passage. The fan is located between the electrodes and the outlet passage and promotes intermixing of the positive and negative ions as the air flow travels towards the outlet passage.

Fans or the like for creating the airflow that carries ions away from the electrode region and out into the room have heretofore been placed upstream from the electrode at a location between the electrodes and the air intake of the ionizer. In the present invention, the fan is situated between the electrodes and the outlet of the ionizer in position to accelerate intermixing of positive and negative ions. This enables the ionizer to be placed closer to objects which are to be protected from electrostatic charge accumulations.

The invention, together with other aspects and advantages thereof, may be further understood by reference to the following description of the preferred embodiments and by reference to the accompanying drawings.

DETAILED DESCRIPTION OF THE PREFERRED EMBODIMENTS

Figure 1:
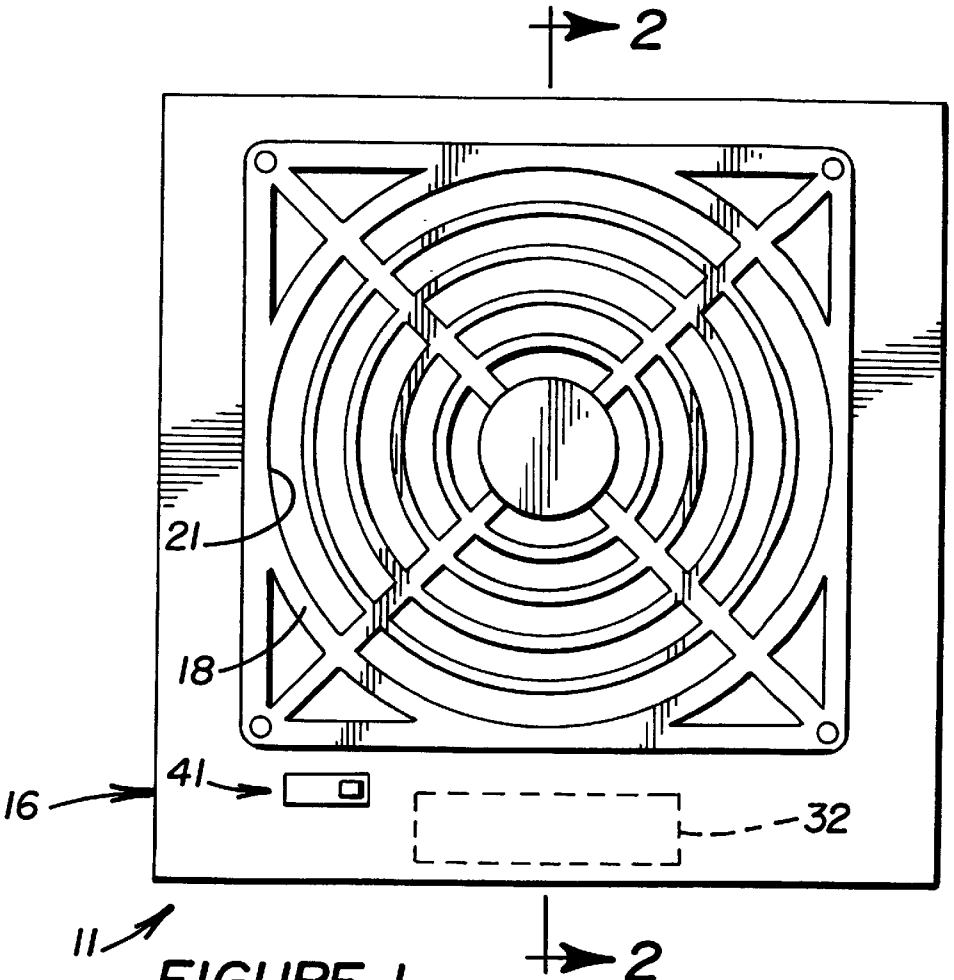
FIG. 1 is a front elevation view of a D.C. bipolar air ionizer in accordance with a preferred embodiment of the invention.
Figure 2:
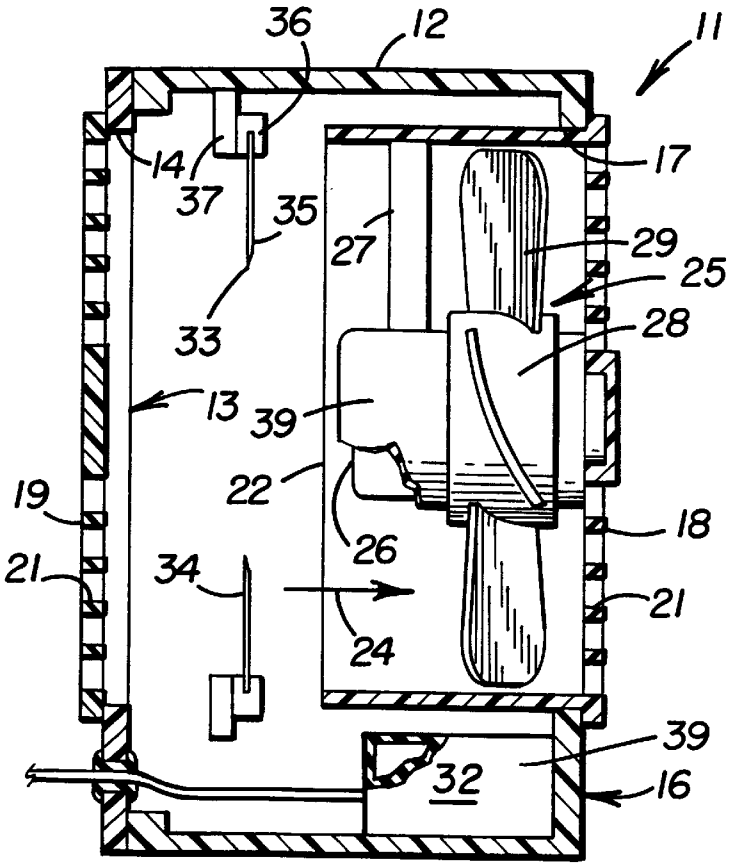
FIG. 2 is an elevation section view of the apparatus of FIG. 1 taken along line 2—2 thereof.

Referring jointly to FIGS. 1 and 2 of the drawings, a bipolar air ionizing apparatus 11 in accordance with this embodiment of the invention includes a hollow housing 12 which is a portable rectangular box in this example. The housing 12 may have any of a variety of other configurations and in some instances may be defined by pre-existing strucures into which the components of the ionizing apparatus are installed.

Housing 12 has a back wall 13 with a broad air inlet passage 14 and a front wall 16 with a similar air outlet passage 17. Grills 18 and 19, each having a plurality of open areas 21, are secured to the front and back walls 16 and 13 respectively to prevent entry of human fingers and other sizable objects into the housing 12.

A portion of the airflow path through housing 12 is defined by a cylindrical duct 22 situated in the front region of the housing behind the air outlet passage 17. The duct 22 is attached to and supported by the housing front wall 16. The airflow 24 is created by a rotary fan 25 having an electrical motor 26 which is positioned in coaxial relationship with duct 22 and which is supported by spider arms 27 which extend to the duct. Motor 26 turns a coaxial hub 28 from which the fan blades 29 extend.

A sub-housing 32 contains components of the electrical circuit of the ionizer 11 that will hereinafter be described and is preferably situated out of the path of the airflow 24, the sub-housing being centered below the air duct 22 in this embodiment.

Molecules of the gases in the airflow 24 are ionized by the intense electrical field in the immediate vicinity of pointed tips 33 of a plurality of needle-like electrodes 34 and 35 that extend into the airflow and to which high voltages are applied. Such electrodes 34, 35 are often referred to as ion emitters although ions do not in fact emerge from the electrodes but are instead created by the interaction of the electrical field with gas molecules that are near the electrode tips 33. The electrodes 34, 35 extend from electrical insulators 36 which in this embodiment are attached to the inner walls of housing 12 through insulative brackets 37. Other electrode mounting techniques may be used.

Figure 3:
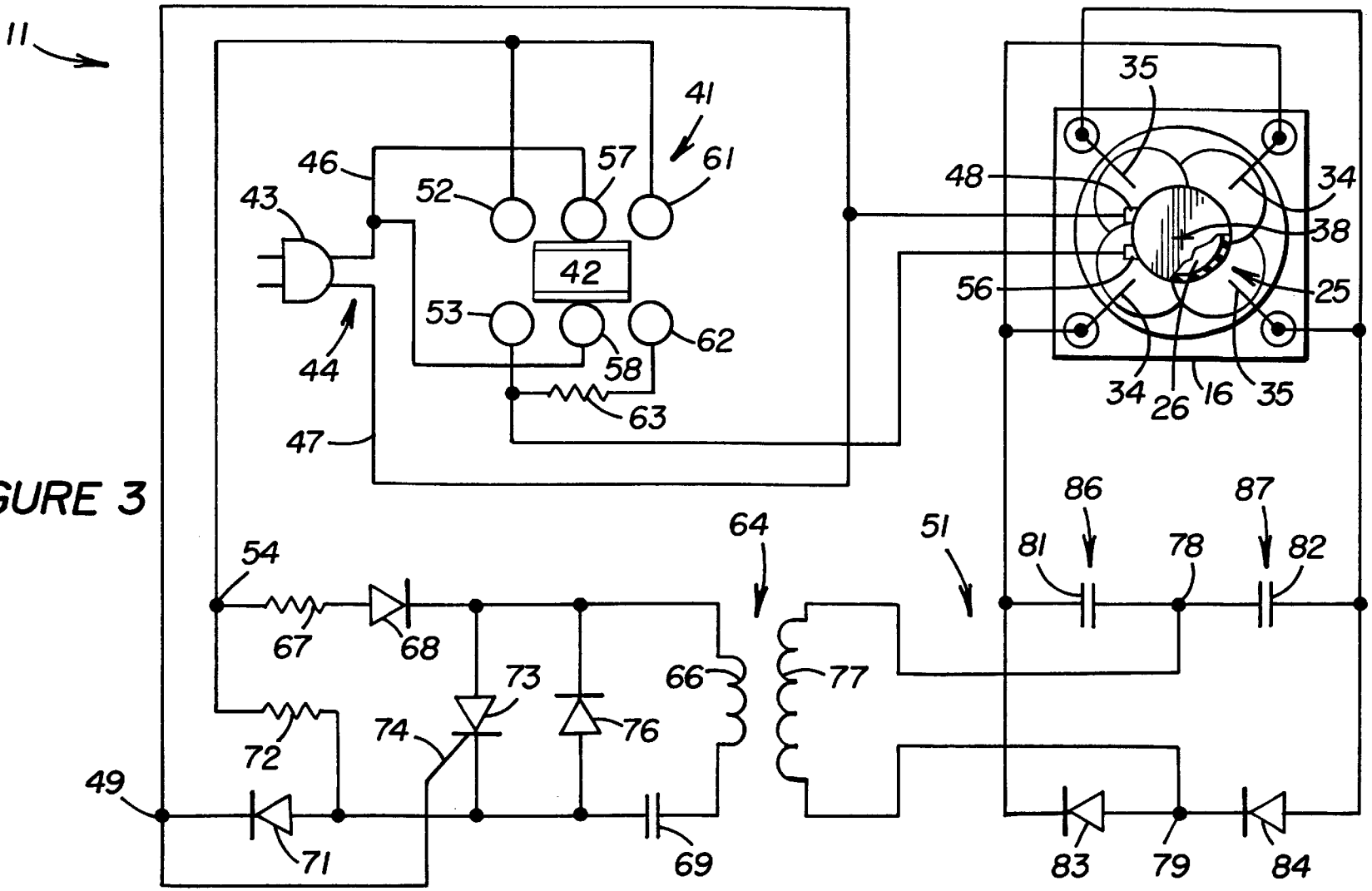
FIG. 3 is an electrical circuit diagram depicting electrical components of the apparatus of the preceding figures.

A minimum of two spaced apart electrodes, including a positive electrode 34 and a negative electrode 35, are needed to establish a self-balancing effect in accordance with the present invention and additional pairs of electrodes may be present to increase ion output. In this embodiment, with reference to FIG. 3, there are two positive electrodes 34 and two negative electrodes 35 situated between duct 22 and the housing backwall 13. The two positive electrodes 34 are colinear and the two negative electrodes 35 are also colinear and oriented at right angles to the positive electrodes. The four electrodes 34, 35 are also preferably coplanar and the pointed tips 33 are equidistantly spaced from the center 38 of the electrode array which center is preferably directly behind the centerline of duct 22 and the rotational axis of fan 25.

A flow of charged ions from an electrode 34, 35 to any nearby grounded conductor or low resistance path to ground detracts from the desired self-balancing effect. Referring again to FIG. 2, this is prevented by forming components that might otherwise provide a low resistance path to ground of plastic or other insulative material or by covering such components with a layer of insulative material. In the present example, housing 12 including grills 18 and 19, duct 22 and hub 28 and blades 29 of fan 25 are all formed wholly of insulative plastic. Components which are necessarily conductive and grounded, such as portions of motor 26 and circuit sub-housing 32, are covered with layers 39 of insulative material.

Referring again to FIG. 3, the electrical circuit of this embodiment of the air ionizer 11 includes a control switch 41 having a sliding conductive member 42 which can be manually shifted from an OFF position to a LOW position or to a HIGH position. Switch 41 receives alternating current from a utility power source through a plug 43 and power cord 44 having a pair of conductors 46 and 47 with conductor 47 being the neutral or grounded conductor. The neutral conductor 47 is connected to one terminal 48 of fan motor 25 and to one input terminal 49 of a high voltage supply 51.

Control switch 41 further includes a first pair of spaced apart contacts 52 and 53 which are respectively connected to the other input terminal 54 of high voltage supply 51 and the other fan motor terminal 56. A second pair of spaced contacts 57 and 58 are each connected to power conductor 46. A third set of spaced apart contacts 61 and 62 respectively connect to high voltage supply terminal 54 and motor terminal 56, the connection between contact 62 and motor terminal 56 being made through a voltage dropping resistor 63.

Sliding member 42 bridges only contacts 57 and 58 at the OFF position of the switch and thus fan 25 and high voltage supply 51 are unenergized. Member 42 bridges the power contacts 57 and 58 as well as contacts 61 and 62 at the LOW position of the switch 41 thereby actuating both the high voltage supply 51 and fan 25. Fan 25 operates at a relatively slow speed at this switch setting as resistor 63 reduces the voltage received by the fan motor 26. At the high setting of switch 41, member 42 bridges power contacts 57 and 58 and contacts 52 and 53. This again energizes high voltage supply 51 and sends full power to fan motor 26 to produce a higher velocity airflow within the apparatus.

High voltage supply 51 applies a continuous positive voltage to electrodes 34 and a continuous negative voltage to electrodes 35, which voltages may typically be in the range from about 3 KV to about 20 KV in order to accomplish air ionization.

Supply 51 includes a voltage step up transformer 64 having a primary winding 66 which is arranged to receive only the positive half cycles of the alternating current that is transmitted to power input terminal 54 through switch 41. In particular, terminal 54 is connected to one end of primary winding 66 through a resistor 67 and diode 68 or other unidirectional circuit element that blocks the negative half cycles from the winding. A capacitor 69 and another diode 71 are connected between the other end of winding 66 and the neutral input terminal 49 with the diode being oriented to transmit positive current to the terminal 49 and to block reversed current. Another resistor 72 connects power terminal 54 with neutral terminal 49 through the same diode 71. An SCR (silicon controlled rectifier) 73 or similar circuit element is connected across the primary winding 66 and capacitor 69 to discharge the capacitor during negative half cycles of the alternating current as will hereinafter be described in connection with the operation of the circuit. SCR 73 is triggered into conduction at such times by a gate connection 74 to neutral terminal 49. Another diode 76 is connected in parallel with SCR 73 and is oriented to conduct current in an opposite direction in order to suppress ringing or oscillation in the circuit following discharge of the capacitor 69.

Transformer 64 is preferably of the ferrite core type and has a secondary winding 77 which provides a voltage step up ratio of 100:1 in this example although other ratios are also suitable. The ends of secondary winding 77 define first and second circuit junctions 78 and 79 respectively of the high voltage region of supply 51. A positive high voltage storing capacitor 81 is connected between junction 78 and the positive electrodes 34 and a negative high voltage storing capacitor 82 is connected between the same junction and negative electrodes 35. A diode 83 conducts positive voltage from junction 79 to capacitor 81 and another diode 84 conducts negative voltage from the same junction to capacitor 82.

In operation, positioning of switch 41 at either the LOW or HIGH settings turns on fan 25 and transmits alternating current to input terminals 49 and 54 of the high voltage supply. Capacitor 69 charges through resistor 67 and diode 68 during the positive half cycles of the alternating current. Positive current also flows from input terminal 54 to input terminal 49 during the positive half cycles through resistor 72 and diode 71. The resulting voltage drop across diode 71 prevents firing of SCR 73 into a conductive state during the positive half cycles.

Gate voltage from terminal 49 causes SCR 73 to become conductive when the voltage at terminal 54 turns negative following each positive half cycle of the alternating curent. This causes an abrupt discharging of capacitor 69 through primary winding 66 and the SCR. Thus a brief high voltage spike is induced in the transformer secondary winding 77 during each negative half cycle of the alternating current. Capacitor 81 charges to a high positive voltage through diode 83 when the voltage spike is rising and capacitor 82 charges to a high negative voltage as the voltage spike decays.

Capacitors 81 and 82 remain continuously charged to high positive and negative voltages until the ionizer 11 is turned off as the charging process reoccurs during each negative half cycle and there is no discharge path having a conductivity sufficiently high to enable a sizable discharge during the course of a single cycle. Thus the capacitors 81 and 82 apply essentially D.C. voltages to the positive and negative electrodes 34 and 35. Consequently, positive ions are continuously created at the tips of electrodes 34 and negative ions are continuously created at the tips of electrodes 35. Positive ions are electrostatically repelled by the charge on the positive electrodes 34 and by each other and are attracted to nearby objects or surfaces having a less positive or neutral or negative charge. Similar effects occur at the tips of the negative electrodes 35. Consequently, the ions travel away from the electrode 34 or 35 at which they were generated and intermix with the airflow through housing 12 and with each other.

The above described air ionizing apparatus 11 inherently maintains a balanced equal output of positive and negative ions and continues to do so in the presence of changing conditions that have heretofore made it necessary to use ion sensors and feedback systems for the purpose. Such self-balancing is brought about by several aspects of the apparatus.

A first such aspect is that the electrodes. 34 and 35, secondary winding 77, circuit junctions 78, 79, the positive high voltage producing side 86 of the circuit including capacitor 81 and diode 83 and the negative high voltage producing side including capacitor 82 and diode 84 are all electrically isolated from ground and from any conductive path capable of conducting direct current. Thus such components, which constitute the high voltage region of high voltage supply 51, are in an electrically floating condition and can acquire a D.C. bias voltage if there is an imbalance in the rate at which positive and negative ions leave the closed system.

If, for example, there is a decrease in the output of positive ions relative to the output of negative ions, positive charge accumulates as there is no path through which it can drain away to ground. This results in a positive D.C. voltage bias in the high voltage region of supply 51 including at electrodes 34 and 35 and circuit junctions 78 and 79. This bias increases the positive voltage at electrodes 34, causing increased positive ion production, and reduces the negative voltage at electrodes 35 thereby re-reducing negative ion output. The production of positive and negative ions is re-equalized. A similar re-equalizing occurs if negative ion output decreases relative to positive ion output although the bias voltage is negative in this case.

Ions produced by an electrode 34 or 35 are strongly attracted by the electrodes of opposite polarity if the electrodes are in proximity to each other. An ion which is drawn to an electrode of opposite polarity is neutralized by charge exchange. Ion losses from this effect can be minimized by spacing the electrodes apart to the extent that is practical given the need for intermixing of positive and negative ions before the ions reach objects that are to be protected from static charge. In some usages of the present invention, where very precise balancing of ion outputs is needed, it may be preferable to provide a relatively close electrode spacing including in some instances a spacing that causes ion flow to be predominately between electrodes of opposite polarity rather than out of the housing 12. This can be advantageous in some applications of the system as decreases in the spacing of the electrodes 34 and 35 bring about a faster response of the system to incipient imbalances of positive and negative ion outputs. The need to maintain an adequate ion output limits the minimal electrode spacing that is practical under most conditions. Electrode spacings below about one inch cause almost all of the ion current to be between electrodes leaving very few ions in the air outflow. The tips of the electrodes 34 and 35 of this particular embodiment are spaced apart by three inches although the spacing may be varied subject to the considerations discussed above.

Self-balancing is further enhanced by equalizing the conductivities of the several paths by which charge can leave the positive and negative electrodes 34 and 35. This includes the ion current leakage paths through air to grounded objects within the housing 12. The conductivities of such paths can be minimized by the hereinbefore described covering of grounded objects with insulation. Positioning the positive and negative electrodes 34 and 35 to be equidistant from grounded components to the extent possible aids in balancing leakage of this kind that cannot be eliminated.

Ion current leakage through air to external objects that are close to the front of the housing 12 can also tend to unbalance the system. This is minimized by the placement of electrodes 34 and 35 towards the back of the insulative housing 12, behind the fan 25. Close spacing of the electrodes 34 and 35 also acts to minimize the effect of any differences in the length of the ion flow paths from the positive and negative electrodes to such objects although as previously discussed electrode spacing must be sufficient to provide for the needed rate of ion output. The above described insulation arrangements and placement of the electrodes 34 and 35 also minimize direct current leakage paths from the high voltage region of supply 51 and substantially equalize such leakage to the extent that it cannot be eliminated.

Figure 4:
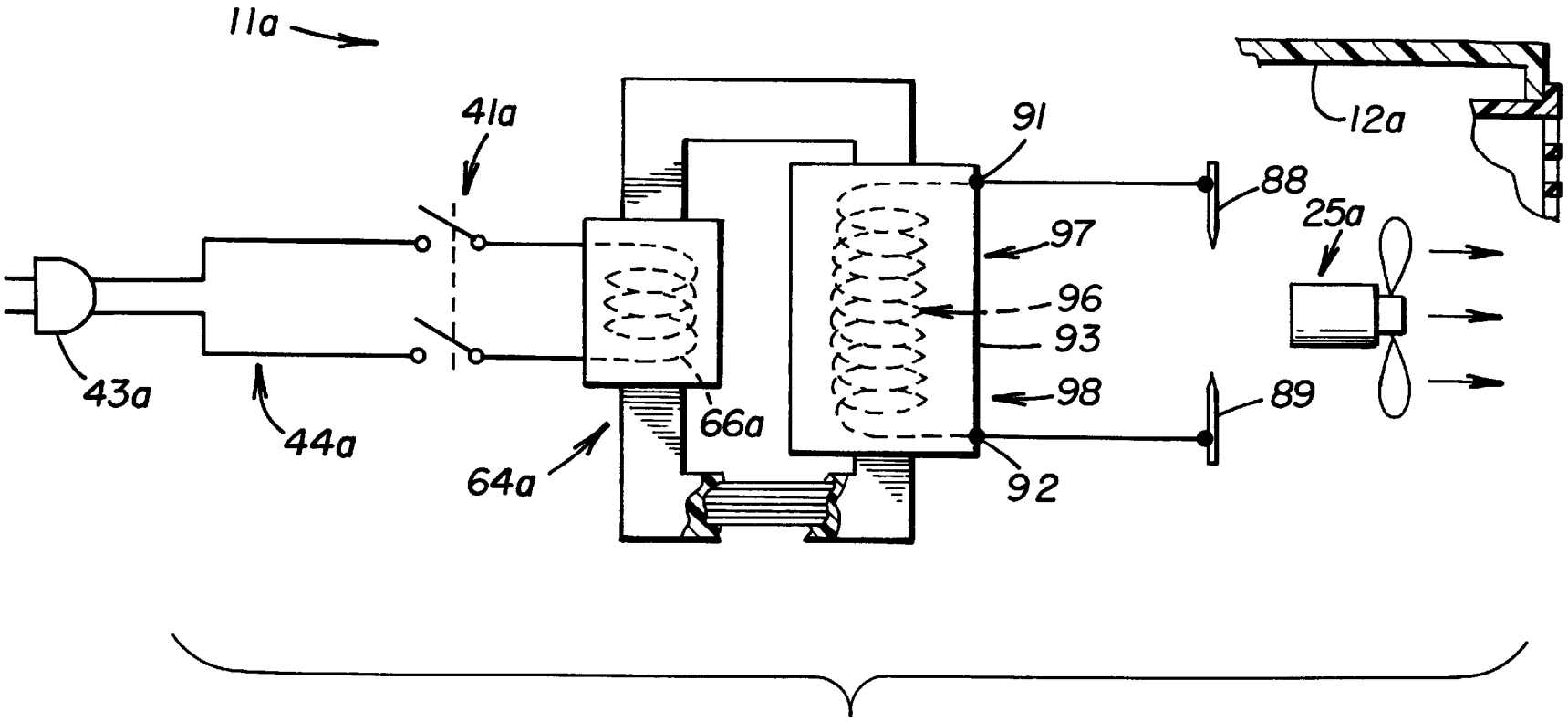
FIG. 4 is a diagramatic depiction of an A.C. bipolar air ionizer embodying the invention.

The above described embodiment of the invention is a D.C. or direct current air ionizer 11 in that high voltage is continuously present at the electrodes 34 and 35. Referring to FIG. 4, the invention can also be embodied in A.C. or pulsed air ionizers lla in which each ion emitter electrode 88 and 89 produces both positive and negative ions during alternating intervals.

The A.C. air ionizer 11*a* of this example includes a voltage step up transformer 64*a* which is of the iron core type in this case. The primary winding of transformer 64*a* recieves alternating current through an on-off control switch 41*a* and an electrical power cord 44*a* having a connector plug 43*a* suitable for engagement with a standard utility power outlet.

Opposite ends 91 and 92 of the secondary winding 93 of transformer 64*a* are coupled to electrodes 88 and 89 respectively. The electrodes 88 and 89, of which there are only two in this particular example, are spaced apart and are disposed in a colinear relationship. Air ionizer 11*a* has been depicted in schematic form in FIG. 4 as the mechanical structure, including the housing 12*a* in which the electrical components are disposed and including a motor driven fan 25*a* for generating an airflow through the housing, may be simlar to corresponding portions of the previously described embodiment of the invention.

In operation, closure of switch 41*a* applies alternating current to primary winding 66*a* of transformer 64*a* inducing cyclical high voltage pulses at the ends 91 and 92 of secondary winding 93 and thus at electrodes 88 and 89, the high voltage pulses which are applied to electrodes 88 and 89 being of opposite polarity at any given instant. Thus the electrodes 88 and 89 generate air ions of opposite polarity during the peaks of the high voltage pulses.

As the high voltage side of the circuit, including secondary winding 93 and electrodes 88 and 89 is isolated from any conductive path capable of conducting direct current to ground, an inherent self-balancing of positive and negative ion output occurs for the same reasons that have been previously described with respect to the first embodiment of the invention. The midpoint 96 of secondary winding 93 is in effect a circuit junction comparable to the circuit junction 78 of the previously described embodiment as one half 97 of the winding constitutes a first high voltage producing circuit that applies voltage of one polarity to electrode 88 while the other half 98 of the winding is a second high voltage producing circuit that concurrently applies high voltage of opposite polarity to the other electrode 89. If output of ions of one polarity starts to drop relative to the output of ions of the other polarity, an accumulation of charge of the one polarity occurs at the electrodes 88 and 89 and in secondary winding 93. This creates a D.C. bias voltage on the electrodes 88 and 89 that increases output of ions of the one polarity and decreases output of ions of the other polarity thereby causing the ion outputs to remain in balance.

While the invention has been described with respect to certain particular embodiments for purposes of example, many modifications and variations are possible and it is not intended to limit the invention except as defined in the following claims.

I claim:

1. Bipolar air ionizing apparatus for generating and releasing a flow of air including intermixed positive and negative ions, comprising:

a housing having an air inlet passage and an ionized air outlet passage that is spaced apart from said inlet passage;

a fan disposed in said housing to draw a flow of air into said housing through said inlet passage for directing a flow of air and ions through said outlet passage and out into the external environment, said fan having a rotary hub and blades which turn about a rotational axis that is aligned between said air inlet passage and said air outlet passage;

a cylindrical air duct encircling said fan and being concentrically oriented on said rotational axis to extend from said fan to said air outlet passage;

first and second pairs of air ionizing electrodes disposed in said housing at a location in the air flow path between said air inlet passage and said fan for producing positive ions about each of the first pair of electrodes and for producing negative ions about each of the second pair of electrodes, each of the electrodes in said first and second pairs of electrodes being diametrically oriented about the rotational axis substantially laterally to the flow of air and equidistantly spaced from the rotational axis of the fans and being sufficiently spaced equidistantly apart about said rotational axis to enable said air flow to carry at least a portion of the positive and negative ions away from respective ones of said first and second pairs of electrodes and out of said housing through said outlet passage without neutralization of the ions from ones of the first and second pairs of electrodes by contact with other of said first and second pairs of electrodes; and a high voltage supply connected to the first and second pairs of electrodes for applying high D.C. voltage of positive polarity to each of the electrodes of the first pair of electrodes and for applying high D.C. voltage of negative polarity to each of the electrodes of the second pair of electrodes to produce supplies of both positive and negative ions in said flow of air about the respective first and second pairs of electrodes to be carried in said air flow through said outlet passage.

2. The bipolar air ionizing apparatus of claim 1, wherein the surfaces of the rotary hub and blades are coated with an electrically insulating material.

3. The bipolar air ionizing apparatus of claim 1, wherein the cylindrical air duct is comprised of an electrically insulating material.

* * * * *